United States Patent [19]

Herman et al.

[11] 4,190,087

[45] Feb. 26, 1980

[54] BREATHER CAP

[75] Inventors: Stephen J. Herman, Evergreen; Joel F. Giurtino, Littleton, both of Colo.

[73] Assignee: Cobe Laboratories, Inc., Lakewood, Colo.

[21] Appl. No.: 918,725

[22] Filed: Jun. 26, 1978

[51] Int. Cl.[2] ..... B65D 59/06

[52] U.S. Cl. ..... 138/96 R; 138/96 T

[58] Field of Search ..... 138/96 R, 96 T; 16/2, 16/108; 285/402, 401, DIG. 2, 376, 396, 361, DIG. 25

[56] References Cited

U.S. PATENT DOCUMENTS

| | | | |
|---|---|---|---|
| 305,140 | 9/1884 | Bradley | 285/396 |
| 2,899,483 | 8/1959 | Robertson et al. | 138/96 R |
| 2,910,308 | 10/1959 | Carr | 285/401 |
| 3,305,120 | 2/1967 | Owen | 138/96 R |
| 3,585,654 | 6/1971 | Jacobs | 285/361 |

*Primary Examiner*—Lenard A. Footland

[57] ABSTRACT

A cap for a tubular fitting featuring a tubular body adapted to fit loosely over the exterior of a tubular fluid fitting and an interior surface inside the tubular body for bearing against a mating exterior surface on the fitting, the tubular body being retained either in a loose breathing position over the tubular fitting or in a sealing position with the mating interior and exterior surfaces tightly engaged. Releasable retaining means are provided to retain the body in either the breathing or sealing position and twisting means are provided to move the cap from one position to the other.

16 Claims, 2 Drawing Figures

BREATHER CAP

FIELD OF THE INVENTION

Figure 1:
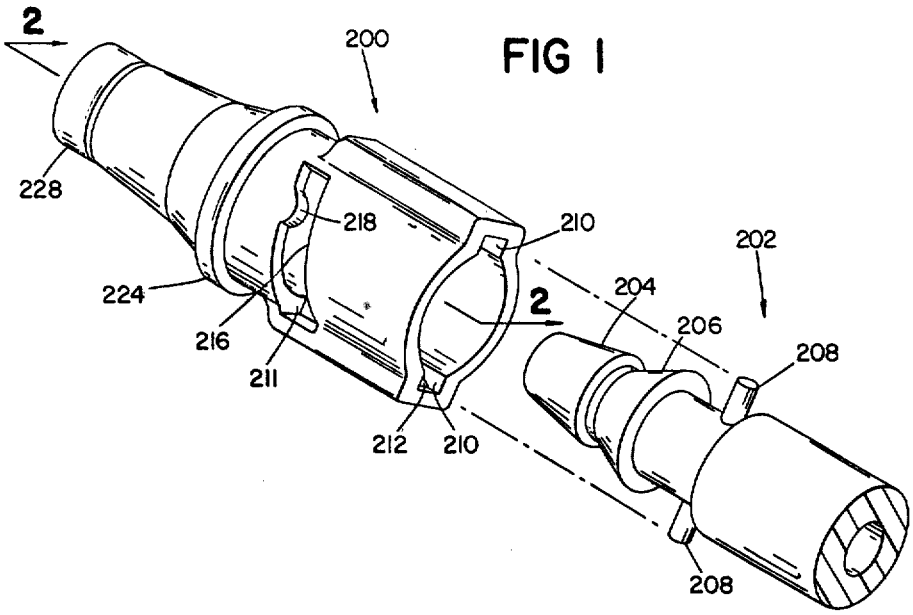

This invention relates to caps for sealing the mouths of fluid fittings.

BACKGROUND OF THE INVENTION

It is often desirable to partially seal the mouth of a tubular fitting so as to allow the fitting to breathe. For example, to sterilize medical devices, sterilizing gases are pumped through the devices and allowed to slowly escape through breather caps installed on fittings. It is also desirable at times to fully seal the same tubular fittings, e.g., when particular fittings are not used during operation of a device. And tubular fittings generally need to be fitted with shipping caps to protect both the fittings and packaging from breakage. Conventionally a number of caps have been employed to serve these multiple purposes. Pliable plastisol caps have been used for shipping and in some instances for breathing, and, with barbed fittings, sealing has been accomplished by clamping the end of a short piece of installed tubing. In addition to the disadvantage of employing separate fittings, plastisol caps tend to work themselves off the fittings during shipment and to leave shreds of plastisol in the fitting interiors.

DeVincent et al. U.S. Pat. No. 4,035,005 shows a hose coupling comprising a pair of mating fittings. One of the fittings has axially spaced pairs of inwardly protruding tangs which snap past a camming surface on the other fitting to lock the fittings in either a venting or sealing position. Sealing is achieved by inserting the other fitting past both pairs of tangs so as to squeeze an O-ring between an exterior surface of the one fitting and an interior surface of the other fitting. Inserting the other fitting past only the first pair of tangs establishes the venting position.

Wirz et al. U.S. Pat. No. 1,890,011 shows a hose coupling with lugs on one fitting received by bayonet slots on the other, for axially forcing the two fittings together against an internal seal when one fitting is twisted relative to the other.

Stone U.S. Pat. No. 512,457 is broadly similar to Wirz, and Bradley U.S. Pat. No. 305,140 shows the same lug and bayonet slot arrangement applied to fastening together two lightning rod sections.

Jacobs U.S. Pat. No. 3,585,654 and Heck U.S. Pat. No. 3,055,366 show a lug and bayonet slot arrangement used only for retention and not for sealing.

SUMMARY OF THE INVENTION

We have discovered that each of these three functions—breathing, sealing, and shipping protection—can be provided using a single low cost cap with a tubular body open at one end and closed at the other and adapted to fit loosely over the exterior of a tubular fluid fitting; an interior surface inside the tubular body for bearing against a mating exterior surface on the fitting; means to retain the tubular body in a loosely fitting position over the tubular fitting wherein the mating interior and exterior surfaces remain unengaged; twisting means to move the tubular body closer to the tubular fitting to tightly engage the mating surfaces; and means to retain the fitting in a sealing, non-venting position with the mating surfaces tightly engaged. The cap of our invention can be installed at the factory for use during device sterilization, shipped with the device to safeguard the fitting and packaging bag, used to vent or bleed the device of gases or liquids during operation, and left in a sealing position during operation on fittings not being used.

In preferred embodiments, frustoconical interior surfaces are provided inside the cap to mate with the frustoconical surfaces of a conventional barbed fitting; longitudinal grooves are provided in the cap interior walls to receive protuberances on the fitting; helical slots in the cap cooperate with the protuberances on the fitting to tightly engage the mating surfaces; and bumps and raised portions in the grooves and slots retain the cap in the loose breathing position and tight sealing position. In these preferred embodiments, the cap can be molded in one piece from pliable plastic and is simple and positively installed with tactile feedback to the user to indicate the differing positions of engagement.

PREFERRED EMBODIMENT

The structure and operation of the preferred embodiment of the invention are as follows:

Structure

The drawings show the preferred embodiment which is then described.

1. Drawings

Figure 2:
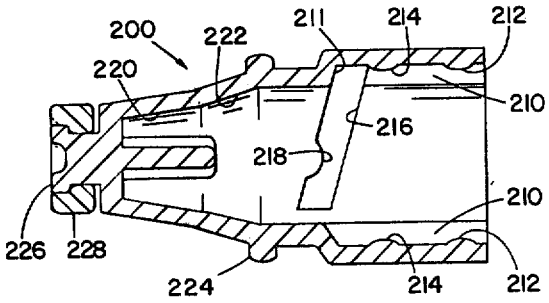

FIG. 1 is an isometric view of said embodiment, showing it being mounted on a fitting; and FIG. 2 is a sectional view taken through 2—2 of FIG. 1.

2. Description

Turning to FIGS. 1 and 2, there is shown a polyethylene breather cap, indicated generally at 200, in position to be mounted on tubular barbed fitting 202 shown cut away from a liquid reservoir structure such as the blood reservoir of a blood oxygenator (not shown) supporting it. Fitting 202 has the conventional frustoconical surfaces 204, 206 ("barbs") designed to accept and tightly engage flexible tubing forced over the fitting, and in back of surfaces 204, 206 it has two cylindrical protuberances 208 spaced 180° apart. Cap 200 has two similarly spaced internal longitudinal grooves 210 which receive protuberances 208 as the cap is slid forward onto fitting 202. Bumps 212 (FIG. 2) at the start of grooves 210 and bumps 214 near the ends of the grooves form a first retaining means to retard relative backward movement of protuberances 208 in the grooves, providing two positions where the cap is loosely retained on the fitting. Helical slots 216 in the cap directed away from the ends of grooves 210 receive protuberances 208 allowing the cap to be twisted. Raised portions 218 near the ends of the slots retain protuberances 208 locking the cap in a seal position. Frustoconical interior surfaces 220, 222 of the cap mate with exterior surfaces 204, 206 of the fitting in an interference fit because the tapers on the fitting exterior surfaces are more gradual than the tapers on the corresponding interior surfaces of the cap. Protruding ring portion 224 strengthens the cap and facilitates handling. Lipped projection 226 supports colored identification ring 228.

Operation

Breather cap 200 is installed on barbed fitting 202 with protuberances 208 sliding into grooves 210 until reaching ends 211 of the grooves, where bumps 214 retain the cap loosely. In this loose fit position gases or liquids are allowed to escape from a reservoir to which fitting 202 could be attached, passing through the annular space between unengaged surfaces 204, 206 and surfaces 220, 222 and leaving the cap along a variety of paths including through slots 216. When the cap is installed on medical devices such as an oxygenator, the loose fit position is used to vent sterilizing gases passed through the reservoir on which fitting 202 is secured. And the position is used whenever it is necessary to bleed gases entrapped in the fitting when liquids are introduced into reservoirs.

To seal the cap to the fitting, the cap is pressed on and then twisted clockwise. Protuberances 208 follow helical slots 216 moving the cap toward the fitting and tightly engaging surfaces 220, 222 against surfaces 204, 206. The mechanical advantage provided by slots 216 working against protuberances 208 in a screwing action facilitates the tight engagement. Raised portions 218 (a second retaining means) retain the protuberances, locking the cap in the sealed position. The loose breathing position would be used during sterilized shipping of an oxygenator or other device to allow sterilizing gases to escape when the device is sterilized inside its shipping carton, to protect the fitting and packaging, and to provide a tortuous incoming path for bacteria. The sealed position would be used during operation of the device to seal in fluids or gases when a particular fitting is not fitted with tubing.

OTHER EMBODIMENTS

Interior sealing surfaces 220, 222 could be replaced by a single deformable sealing member positioned in the closed end of the breather cap, perpendicular to the longitudinal axis of the cap, and sealing against the mouth of the tubular fitting.

INCORPORATION BY REFERENCE

We incorporate by reference the copending U.S. Pat. application of Donn D. Lobdell and Stephen J. Herman entitled "Gas Exchange Apparatus", Ser. No. 917,350.

What is claimed is:

1. A removable cap for sealing the end of a barbed fitting for a fluid reservoir, said barbed fitting being of the type used for connecting tubing and having a mouth with a first exterior surface in the shape of a circular edge surrounding said mouth, a second exterior surface in the shape of a tapered surface of revolution surrounding said mouth, said tapered surface being for stretching said tubing radially during installation, and a raised portion axially behind said tapered surface, said cap comprising:

a tubular body with one open end and one closed end, said tubular body adapted to slip loosely over the exterior of said tubular fitting, a first interior surface of revolution in the interior of said tubular body said interior surface being tapered to bear against one of said exterior surfaces on said barbed fitting and thereby provide a fluid-tight annular seal between said interior and exterior surfaces, first retaining means for preventing said cap from moving axially away from a venting position in which said cap fits loosely over said barbed fitting and said interior and exterior surfaces do not engage, whereby fluids can be vented from said reservoir, helical means in the wall of said tubular body for cooperating with said raised portion of said barbed fitting, for moving said cap into a sealing position with said fitting wherein said interior and exterior surfaces are tightly engaged, second retaining means for preventing said cap from rotating relative to said fitting while in said sealing position to thereby maintain tight engagement between said interior and exterior surfaces, said first and second retaining means each being releasable and said helical means being reversible, for removing said cap from said fitting and for moving said cap back and forth between said sealing and venting positions.

2. A removable cap for sealing the end of a tubular fitting for a fluid reservoir, said tubular fitting having a mouth and a first exterior surface surrounding said mouth, said cap comprising:

a tubular body with one open end and one closed end, said tubular body adapted to slip loosely over the exterior of said tubular fitting, a first interior surface in the interior of said tubular body for bearing against said first exterior surface on said tubular fitting, said first interior surface being frustoconical to mate with a frustoconical first exterior surface on said fitting, first means to retain said tubular body in a loose fitting position over said tubular fitting, wherein said interior and exterior surfaces do not engage, for venting gases or liquids from said reservoir, twisting means to move said tubular body closer to said tubular fitting to tightly engage said interior and exterior surfaces, and second means to retain said tubular body in a sealing, nonventing position closer to said tubular fitting to maintain said tight engagement between surfaces, said first and second means to retain each being releasable and said twisting means being reversible, for moving said cap from said sealing position to said venting position and from said venting position to said sealing position.

3. The cap of claim 2 wherein said second means to retain is twistably releasable.

4. The cap of claim 2 wherein said cap has an exterior surface that is smooth for preventing tearing of packaging surrounding the fitting and reservoir during shipping.

5. The cap of claim 2 wherein said tubular body and first interior surface are adapted to fit over and seal against a frustoconical exterior surface of a barbed fitting on a medical device reservoir, whereby in said venting position sterilizing gases can escape through said barbed fitting.

6. The cap of claim 2 wherein said first interior surface and said first exterior surface are concentric frustoconical surfaces with differing degrees of taper, whereby the difference in taper produces an interference and tightly sealing fit between said surfaces in said sealing position.

7. The cap of claim 6 wherein the degree of taper of said first exterior surface is less than the degree of taper of said first interior surface.

8. The cap of claim 2 wherein said cap is molded from a pliable plastic material selected to assure sealing between said first interior and exterior surfaces, to prevent tearing of packaging surrounding said fitting and reservoir during shipping, and to protect said fitting from breakage during shipping and use.

9. The cap of claim 2 further comprising an identification ring installed on an extension of said tubular body.

10. The cap of claim 2 further comprising a second interior surface in said tubular body adjacent said first interior surface for mating with a second exterior surface on said fitting adjacent said first exterior surface.

11. The cap of claim 2 wherein said twisting means to move said tubular body closer to said tubular fitting includes screw means for longitudinally moving said tubular body under mechanical advantage as said body is rotated.

12. The cap of claim 11 wherein said screw means includes a helical slot in the wall of said body for cooperating with a protuberance on said fitting.

13. The cap of claim 12 wherein said second means to retain said tubular body in a sealing position includes a raised portion in said helical slot.

14. A removable cap for sealing the end of a tubular fitting for a fluid reservoir, said tubular fitting having a mouth and a first exterior surface surrounding said mouth, said cap comprising:

a tubular body with one open end and one closed end, said tubular body adapted to slip loosely over the exterior of said tubular fitting, a first interior surface in the interior of said tubular body for bearing against said first exterior surface on said tubular fitting, a first means to retain said tubular body in a loose fitting position over said tubular fitting, wherein said interior and exterior surfaces do not engage, for venting gases or liquids from said reservoir, twisting means to move said tubular body closer to said tubular fitting to tightly engage said interior and exterior surfaces, second means to retain said tubular body in a sealing, nonventing position closer to said tubular fitting to maintain said tight engagement between surfaces, said first and second means to retain each being releasable and said twisting means being reversible, for moving said cap from said sealing position to said venting position and from said venting position to said sealing position, and a longitudinal groove in the interior wall of said tubular body, said groove commencing at said open end and ending intermediate said open and closed ends, and said groove positioned to cooperate with a protuberance on an exterior surface of said tubular fitting to retain said cap as it is slid onto said fitting.

15. The cap of claim 14 wherein said first means to retain said tubular body in a loosely fitting position includes a bump along said groove, said bump retarding backward movement of said protuberance in said groove.

16. A removable cap for sealing the end of a tubular fitting for a fluid reservoir, said tubular fitting having a mouth and a first exterior surface surrounding said mouth, said cap comprising:

a tubular body with one open end and one closed end, said tubular body adapted to slip loosely over the exterior of said tubular fitting, a first interior surface in the interior of said tubular body for bearing against said first exterior surface on said tubular fitting, first means to retain said tubular body in a loose fitting position over said tubular fitting, wherein said interior and exterior surfaces do not engage, for venting gases or liquids from said reservoir, twisting means to move said tubular body closer to said tubular fitting to tightly engage said interior and exterior surfaces, second means to retain said tubular body in a sealing, nonventing position closer to said tubular fitting to maintain said tight engagement between surfaces, said first and second means to retain each being releasable and said twisting means being reversible, for moving said cap from said sealing position to said venting position and from said venting position to said sealing position, and a pair of opposed longitudinal grooves in the interior wall of said tubular body, said grooves commencing at said open end and ending intermediate said open and closed ends, and said grooves positioned to cooperate with a pair of protuberances on an exterior surface of said tubular fitting to angularly retain said cap as it is slid onto said fitting, and a pair of opposed helical slots in the wall of said tubular body for cooperating with said pair of protuberances, said helical slots extending from said longitudinal grooves and continuing helically in a direction toward said closed end, thereby to provide a screw mechanical advantage as said tubular body is rotated to tightly engage said interior and exterior surfaces.

* * * * *